US009581332B2

(12) United States Patent
Yamamoto et al.

(10) Patent No.: US 9,581,332 B2
(45) Date of Patent: Feb. 28, 2017

(54) BURNER COMBUSTION METHOD

(75) Inventors: Yasuyuki Yamamoto, Hokuto (JP); Kimio Iino, Kai (JP); Yoshiyuki Hagihara, Kofu (JP); Tomoyuki Haneji, Kai (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 688 days.

(21) Appl. No.: 13/805,836

(22) PCT Filed: Jun. 28, 2011

(86) PCT No.: PCT/JP2011/064757
§ 371 (c)(1),
(2), (4) Date: Dec. 20, 2012

(87) PCT Pub. No.: WO2012/002362
PCT Pub. Date: May 1, 2012

(65) Prior Publication Data

US 2013/0095436 A1 Apr. 18, 2013

(30) Foreign Application Priority Data

Jun. 29, 2010 (JP) ..... 2010-147576

(51) Int. Cl.
*F23N 1/02* (2006.01)
*F23C 99/00* (2006.01)
*F23C 5/28* (2006.01)

(52) U.S. Cl.
CPC ..... *F23N 1/02* (2013.01); *F23C 5/28* (2013.01); *F23C 99/00* (2013.01); *F23C 2205/10* (2013.01); *F23C 2205/20* (2013.01)

(58) Field of Classification Search
CPC ... F23N 3/06; F23N 3/065; F23N 1/02; F23C 2205/00; F23C 2205/10; F23C 2205/20; F23C 99/00; F23C 5/28
(Continued)

(56) References Cited

U.S. PATENT DOCUMENTS 4,007,000 A * 2/1977 Graffman ..... 431/1
4,846,665 A 7/1989 Abbasi
(Continued)

FOREIGN PATENT DOCUMENTS

CN 101040148 9/2007
CN 101201163 6/2008
(Continued)

OTHER PUBLICATIONS

Notice of Allowance and English translation in JP 2010-147576 mailed Aug. 6, 2013.
(Continued)

*Primary Examiner* — Alfred Basichas
(74) *Attorney, Agent, or Firm* — Nixon & Vanderhye P.C.

(57) ABSTRACT

A burner combustion method is employed in which at least two burners (2) are disposed opposite each other in a furnace (1) so as to cause combustion, the method comprising:

cyclically changing at least one of a flow rate of a fuel fluid and a flow rate of an oxidant fluid supplied to the respective burners (2) while cyclically changing a concentration of oxygen in the oxidant fluid thereby cyclically changing an oxygen ratio obtained by dividing a supply oxygen amount by a theoretically required oxygen amount, whereby, the burners (2) are made to cause combustion in a cyclical oscillation state, wherein with respect to the cyclical change in an oscillation state of the burners (2), a phase difference is provided between a cyclical change in an oscillation state of at least one burner (2) and cyclical changes in oscillation states of other burners (2).

14 Claims, 8 Drawing Sheets

(58) Field of Classification Search
USPC ..... 431/1, 8
See application file for complete search history.

(56) References Cited

U.S. PATENT DOCUMENTS

| | | | | |
|---|---|---|---|---|
| 5,302,111 | A * | 4/1994 | Jouvaud et al. | 431/1 |
| 6,398,547 | B1 * | 6/2002 | Joshi et al. | 432/54 |
| 2008/0292999 | A1 | 11/2008 | Koder et al. | |

FOREIGN PATENT DOCUMENTS

| | | | |
|---|---|---|---|
| CN | 100582574 | | 1/2010 |
| EP | 0046898 | A1 | 3/1982 |
| EP | 0046898 | B1 | 2/1984 |
| JP | 5-215311 | | 8/1983 |
| JP | 5-215311 | | 8/1993 |
| JP | 6-213411 | | 8/1994 |
| JP | 10-141629 | | 5/1998 |
| JP | 2000-171005 | | 6/2000 |
| JP | 2000-171032 | | 6/2000 |
| JP | 2001-165410 | | 6/2001 |
| JP | 2001-311505 | | 11/2001 |
| JP | 2008-527303 | | 7/2008 |
| TW | 330235 | | 4/1998 |
| WO | WO 03083372 | A1 * | 10/2003 |

OTHER PUBLICATIONS

International Search Report for PCT/JP2011/064757, mailed Sep. 20, 2011.

Taiwanese Patent Office, "Office Action and Search Report," (3 pages) issued in connection with Taiwanese Patent Application No. 100122789, dated Apr. 22, 2015, along with English language Translation of the Search Report (1 page).

* cited by examiner

BURNER COMBUSTION METHOD

This application is the U.S. national phase of International Application No. PCT/JP2011/064757, filed 28 Jun. 2011, which designated the U.S. and claims priority to Japan Application No. 2010-147576, filed 29 Jun. 2010, the entire contents of each of which are hereby incorporated by reference.

TECHNICAL FIELD

The present invention relates to a burner combustion method.

BACKGROUND ART

At present, global environmental issues are gaining increasingly more attention. One of the important and urgent tasks is the reduction of nitrogen oxides represented by $NO_x$. In methods for reducing $NO_x$, techniques for suppressing $NO_x$ emission are important, and include exhaust gas recirculation, lean combustion, thick and thin combustion, multistage combustion, and the like, which are widely used from the industrial to the customer market. Low-$NO_x$ combustors to which such a technique is applied have promoted the reduction of $NO_x$ to some degree. However, more effective methods for reducing $NO_x$ have been further required.

One of the methods for reducing $NO_x$ that has hitherto been studied and developed is a method which involves cyclically changing the flow rate of fuel, or air or the like serving as an oxidant to perform one kind of thick and thin combustion temporally controlled (hereinafter referred to as a "forced oscillating combustion"). This kind of method has been proposed (see Patent Literatures 1 to 6).

In the method, the flow rate of supply of one of a fuel fluid and an oxidant fluid, or both the fuel fluid and the oxidant fluid is changed to vary an oxygen ratio of combustion flame (that is, a value obtained by dividing an amount of supply of oxygen by a theoretically required oxygen amount) thereby alternately performing fuel-rich combustion and fuel-lean combustion. As a result, the method achieves the reduction of $NO_x$ in the combustion gas.

Patent Literature 7 discloses a method for reducing nitrogen oxides which involves using oscillating combustion, that is, so-called forced oscillating combustion under a high concentration of pure oxygen as an oxidant, and also a device for performing the method.

In general, a heating furnace and a melting furnace are provided with a plurality of burners. In applying the forced oscillating combustion to each burner, combustion conditions and oscillation cycles should be appropriately controlled to obtain a great effect of $NO_x$ reduction.

CITATION LIST

Patent Literature

[Patent Literature 1]
European Patent No. 0 046 898
[Patent Literature 2]
U.S. Patent No. 4,846,665
[Patent Literature 3]
Japanese Unexamined Patent Application, First Publication No. Hei 06-213411
[Patent Literature 4]
Japanese Unexamined Patent Application, First Publication No. 2000-171005

[Patent Literature 5]
Japanese Unexamined Patent Application, First Publication No. 2000-171032
[Patent Literature 6]
Japanese Unexamined Patent Application, First Publication No. 2001-311505
[Patent Literature 7]
Japanese Unexamined Patent Application, First Publication No. Hei 05-215311

SUMMARY OF INVENTION

Technical Problem

However, the present inventors have performed additional tests so as to confirm the $NO_x$ reduction effect disclosed in the above patent literatures and found that some of the above patent literatures exhibit an $NO_x$ reduction effect; however, they are of no value in terms of practical use.

An object to be achieved by the present invention is to provide a method and device for combustion of a burner that is of practical value and which exhibits a great effect of $NO_x$ reduction as compared to the case in the prior art.

Solution to Problem

In order to solve the above problems, the present inventors have conducted intensive studies for developing a $NO_x$ reduction method which is of practical value, and found that at least one of the flow rate of a fuel fluid and the flow rate of an oxidant which are supplied to the burners is cyclically changed, and at the same time, the concentration of oxygen in the oxidant fluid is also cyclically changed thereby causing forced oscillating combustion, and thus exhibiting a great effect of $NO_x$ reduction as compared to the case in the prior art.

That is, a first aspect of the present invention provides a burner combustion method in which at least two burners are disposed opposite each other in a furnace so as to cause combustion, the method comprising:

cyclically changing at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, wherein with respect to the cyclical change in an oscillation state of the burners, a phase difference is provided between a cyclical change in an oscillation state of at least one burner and cyclical changes in oscillation states of other burners.

In the first aspect, a phase difference is preferably provided between a cyclical change in flow rate of the fuel fluid supplied to each burner and a cyclical change in oxygen concentration and oxygen ratio.

In the first aspect, the frequency of the cyclical change in oxygen ratio is preferably 20 Hz or less.

In the first aspect, the frequency of the cyclical change in oxygen ratio is preferably 0.02 Hz or more.

In the first aspect, it is preferred that a difference between an upper limit and a lower limit of the oxygen ratio cyclically changed be 0.2 or more, and an average value of the oxygen ratio per cycle be 1.0 or more.

In the first aspect, all burners are preferably synchronized in terms of at least one of the cyclical change in oxygen ratio and the cyclical change in oxygen concentration thereby causing combustion.

In the first aspect, a phase difference in the cyclical change between the oscillation states of the burners disposed opposite each other is preferably π.

In the first aspect, it is preferred that, when performing combustion using a burner array including one or more burners, two or more pairs of the burner arrays be disposed on a sidewall of the furnace, and a phase difference between a cyclical change in an oscillation state of the burner forming each burner array, and a cyclical change in an oscillation state of the burner forming another burner array disposed adjacent to the above burner array be π.

In the first aspect, it is preferred that, when performing combustion using a burner array including one or more burners, sidewalls of the furnace be opposed to each other, and n pairs of burner arrays be disposed on one sidewall, and a phase difference between a cyclical change in an oscillation state of the burner forming each burner array, and a cyclical change in an oscillation state of the burner forming another burner array disposed adjacent to the above burner array be 2π/n.

In the first aspect, a phase difference is preferably provided between the cyclical change in an oscillation state of at least one burner and the cyclical change in an oscillation state of another burner thereby keeping the pressure inside the furnace constant.

A second aspect of the present invention provides a combustion device of a burner in which at least two burners are disposed opposite each other in a furnace so as to cause combustion, characterized in that:

the combustion device is adapted to cyclically change at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, and with respect to the cyclical change in an oscillation state of the burners, a phase difference is provided between a cyclical change in an oscillation state of at least one burner and cyclical changes in oscillation states of other burners.

In the second aspect, it is preferred that the combustion device include a fuel supply pipe for supplying the fuel, an oxygen supply pipe for supplying oxygen, and an air supply pipe for supplying air, and the supplied oxygen and air form the oxidant, and the combustion device include forced oscillation means for forcedly oscillating the flows of the supplied fuel, oxygen, and air via the respective pipes.

In the second aspect, it is preferred that a detector for grasping an atmosphere state of the furnace be disposed in the furnace, and the combustion device include a control system for changing the flow rate of the fuel fluid or the oxidant fluid, or the cycle of the forced oscillation, based on data detected by the detector.

Advantageous Effects of Invention

The present invention can provide a combustion method that can largely and reliably reduce the amount of $NO_x$. The present invention can be applied not only to a newly-designed heating furnace, but also a combustion burner of an existing heating furnace.

DESCRIPTION OF EMBODIMENTS

A burner combustion method according to one embodiment to which the present invention is applied will be described below in detail with reference to the accompanying drawings. In some drawings used for the following description, distinctive parts are enlarged for convenience in order to simplify the parts, and thus the dimension ratio between respective components is not necessarily the same as that actually used.

[First Embodiment]

<Combustion Device>

Figure 1:
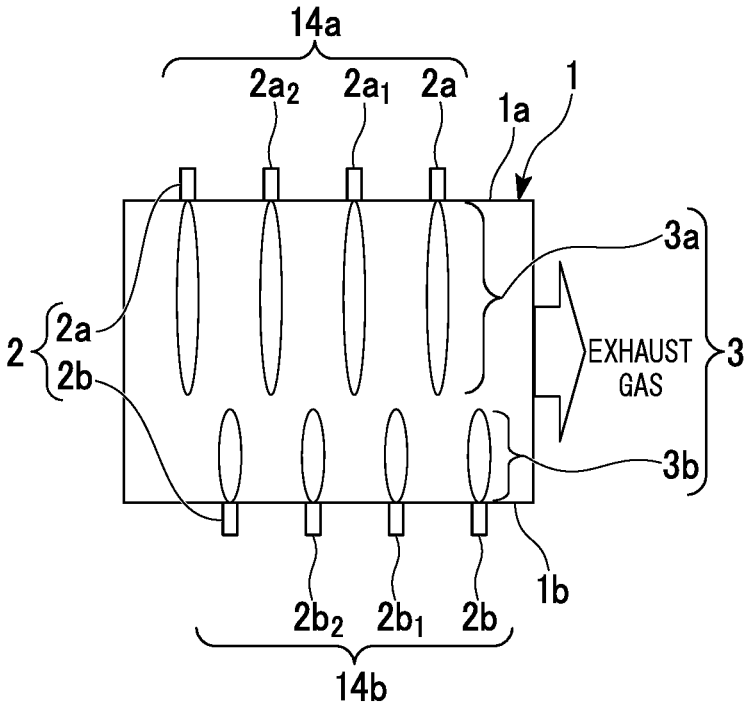
FIG. 1 is a plan view showing a furnace according to a first embodiment of the present invention.
Figure 2:
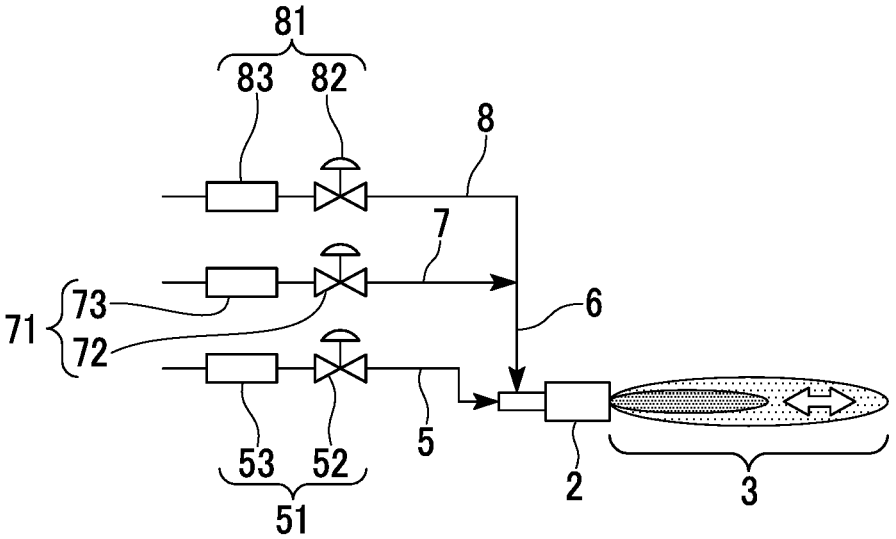
FIG. 2 is a schematic diagram showing supply pipes of a burner used according to the first embodiment of the present invention.

As shown in FIGS. 1 and 2, a combustion device used in a first embodiment of the present invention includes a furnace 1, burners 2 for forming a combustion flame 3 in the furnace 1, and various types of pipes 5, 6, 7, and 8 for supplying a fuel fluid and an oxidant fluid to the burners 2.

As shown in FIG. 1, the furnace 1 may be either a heating furnace or a melting furnace. The furnace 1 extends in the longitudinal direction, and has a sidewall 1*a* and a sidewall 1*b* opposed to each other. The sidewall 1*a* is provided with a plurality of burners 2*a*, and the sidewall 1*b* is also provided with a plurality of burners 2*b*. As mentioned above, the furnace 1 has a so-called side burner structure including the burners 2*a* and 2*b* disposed on both sidewalls 1*a* and 1*b* in the longitudinal direction for forming combustion flames 3*a* and 3*b*.

In the present embodiment, the number of the burners 2*a* provided on the sidewall 1*a* is the same as that of the burners 2*b* provided on the sidewall 1*b*, but may be different therefrom.

The burners 2*a* and 2*b* are disposed to form the combustion flames 3*a* and 3*b* extending from the respective sidewalls 1*a* and 1*b* with the burners formed therein on the opposed sidewalls 1*b* and 1*a*. That is, the burner 2*a* forms the combustion flame 3*a* extending toward the sidewall 1*b*, and the burner 2*b* forms the combustion flame 3*b* extending toward the sidewall 1*a*. The combustion flames 3*a* from the burners 2*a* and the combustion flames 3*b* from the burners 2*b* are alternately disposed within the furnace 1 thereby forming the combustion flame 3.

As mentioned below, each burner 2 causes combustion in a cyclical oscillation state (forced oscillating combustion). At that time, the oscillation state is controlled in units of burner arrays, each comprised of one or more burners 2.

In the present embodiment, all burners 2*a* provided on the sidewall 1*a* form a burner array 14*a*, so that the oscillation states of all the burners 2*a* are controlled in the same manner. Furthermore, all burners 2*b* provided on the sidewall 1*b* form a burner array 14*b*, so that the oscillation states of all the burners 2*b* are controlled in the same manner. The combustion of each burner 2 will be described later.

As shown in FIG. 2, each burner 2 is connected to the fuel supply pipe 5 for supplying the fuel fluid, and the oxidant supply pipe 6 for supplying the oxidant fluid. The oxidant supply pipe 6 is branched into the oxygen supply pipe 7 and the air supply pipe 8 on its upstream side.

The fuel supply pipe 5, the oxygen supply pipe 7, and the air supply pipe 8 are provided with forced oscillation means 51, 71, and 81 for forcedly oscillating the flows of the fluids supplied to the pipes, respectively.

The phrase "forcedly oscillating the flow of the fluid" means that the flow rate of the fluid is cyclically adjusted. Specifically, the forced oscillation means 51, 71, and 81 correspond to control units including flow rate adjustment valves 52, 72, and 82 provided in the supply pipes 5, 7, and 8, and flowmeters 53, 73, and 83 for controlling the flow rate adjustment valves 52, 72, and 82.

Fuel supplied by the fuel supply pipe 5 may be any other one as long as it is appropriate for the combustion of the burner 2, and can include, for example, liquid natural gas (LNG) and the like.

Oxygen is supplied from the oxygen supply pipe 7, but is not necessarily pure oxygen and should be a desired one from the viewpoint of the relationship with the below-mentioned oxygen concentration. Air is supplied from the air supply pipe 8, but a combustion exhaust gas except for air taken from the atmosphere can also be used as the air. Upon use of the combustion exhaust gas, the concentration of oxygen can be decreased to less than 21% (concentration of oxygen in the air).

Figure 12:
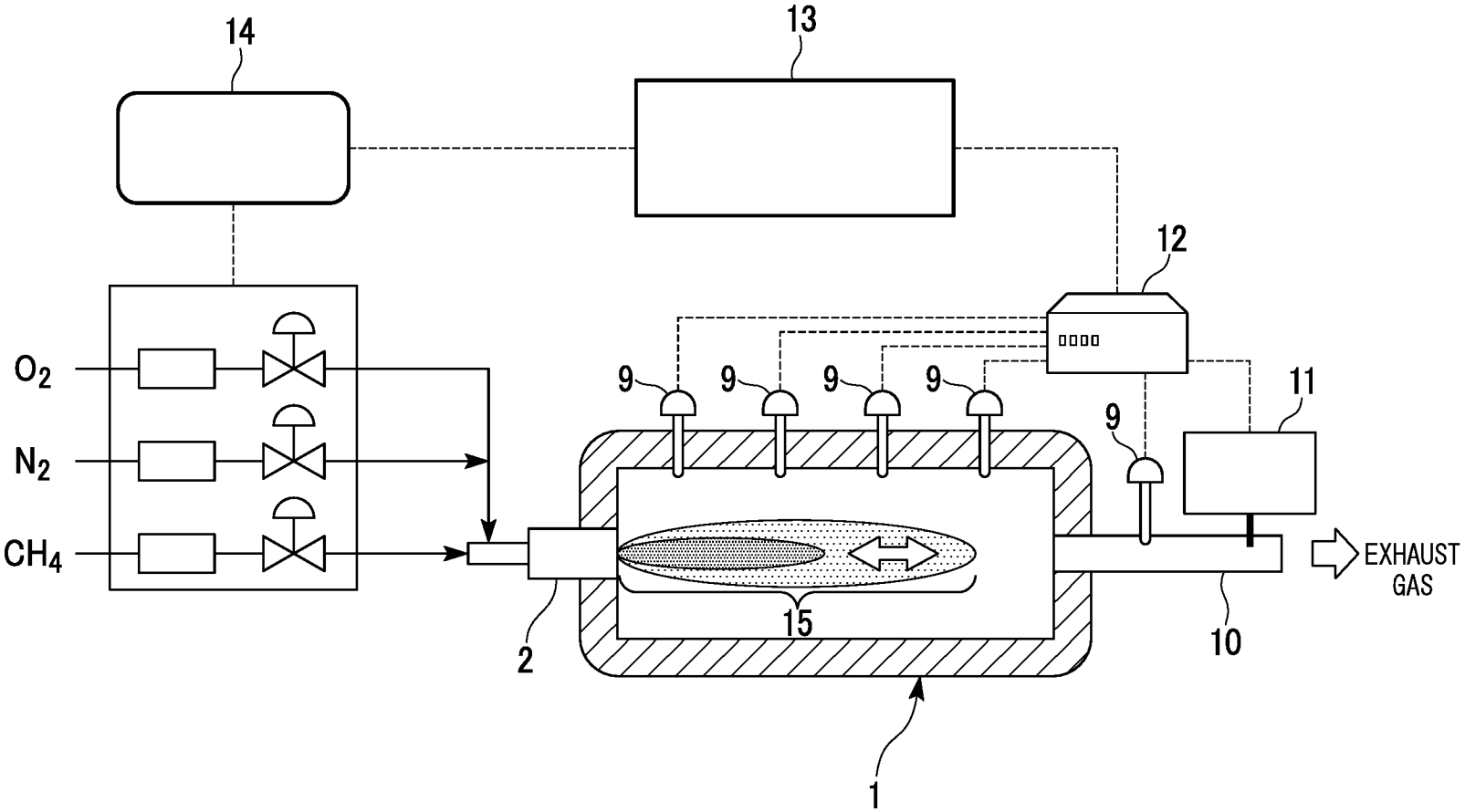
FIG. 12 is a plan view showing a combustion device of the present invention.

As shown in FIG. 12, various types of detectors are preferably provided in the furnace 1 to timely respond to the state inside the furnace 1. That is, the temperature inside the furnace 1 is measured by temperature sensors 9, and the concentration of an exhaust gas ($NO_x$, CO, $CO_2$, $O_2$) discharged from the furnace 1 through a gas duct 10 is measured by a continuous exhaust gas concentration-measuring device 11. Furthermore, data obtained by the detectors is stored in a data storage unit 12. A control system 13 is preferably provided for grasping the atmosphere state inside the furnace 1 based on the data thereby automatically and appropriately changing the flow rate of the fuel fluid or oxidant fluid, or the cycle of the forced oscillation. Specifically, the control system 13 forcedly oscillates the flow of fluid supplied from each of various pipes through a control unit 14. As a result, the oscillation state of an oscillating combustion 15 at the burners 2 is cyclically changed.

<Flow Rate of Oxidant Fluid, and Concentration of Oxygen in Oxidant Fluid>

Next, the flow rate of the oxidant fluid and the concentration of oxygen in the oxidant fluid will be described below. In the following description for convenience, pure oxygen, air (whose oxygen concentration is about 21%), and liquid natural gas (LNG) are supplied from the oxygen supply pipe 7, the air supply pipe 8, and the fuel supply pipe 5, respectively. The concentration of oxygen in the present specification is represented in terms of "% by volume".

In the present embodiment, the oxidant fluid is comprised of pure oxygen and air. One or both of the flow rate of pure oxygen supplied from the oxygen supply pipe 7 and the flow rate of air supplied from the air supply pipe 8 is controlled to cyclically change over time by the forced oscillation means 71 and 81.

The flow rate of pure oxygen and the flow rate of air may be controlled in any way as long as the concentration of oxygen in the oxidant fluid cyclically changes. The sum of the flow rate of the pure oxygen and the flow rate of the air (i.e., flow rate of the oxidant fluid) may be constant or cyclically changed.

In order to set the flow rate of the oxidant fluid constant, for example, a cyclical change in flow rate of pure oxygen and a cyclical change in flow rate of air should have the same waveform and the same fluctuation range with a phase difference therebetween set to $\pi$. With the constitution, an increase or decrease in flow rate of the pure oxygen is offset by an increase or decrease in flow rate of the air, so that the flow rate of the oxidant fluid supplied to the burners 2 is controlled to the constant level.

In this case, the minimum of the flow rate of each of the pure oxygen and air is preferably controlled to zero (0). Such control can change the concentration of oxygen in the oxidant fluid in a range of about 21 to 100%.

That is, when the flow rate of pure oxygen contained in the oxidant fluid is 0 (zero), the concentration of oxygen in the oxidant fluid is equal to the concentration of oxygen in the air, and thus is about 21%. In contrast, when the flow rate of air contained in the oxidant fluid is 0 (zero), the oxidant fluid is comprised of only pure oxygen, and thus the concentration of oxygen is 100%.

In contrast, in order to cyclically change the flow rate of the oxidant fluid, for example, the flow rate of pure oxygen may be changed at regular intervals while supplying a constant amount of air. In this case, when the flow rate of the pure oxygen is maximized, the concentration of oxygen in the oxidant fluid becomes maximum, and thus the concentration of oxygen in the oxidant fluid becomes minimum when the flow rate of the pure oxygen is minimized.

For example, the flow rate of the pure oxygen is controlled such that the maximum flow rate of the pure oxygen is set to the same level as the flow rate of the air, and such that the minimum flow rate thereof is set to 0 (zero), whereby the concentration of oxygen in the oxidant fluid cyclically changes in a range of about 21 to 61%. That is, when the flow rate of the pure oxygen is maximized, the flow rate ratio of the pure oxygen to the air is 1:1, so that the concentration of oxygen in the oxidant fluid is about 61%. When the flow rate of the pure oxygen is minimized, the oxidant fluid is comprised of only air, so that the concentration of oxygen is about 21%.

While the method for changing the flow rate of pure oxygen at regular intervals with the flow rate of air set constant has been described above as the method for cyclically changing the flow rate of the oxidant fluid, the flow rate of air may be cyclically changed with the flow rate of pure oxygen set constant, or both the flow rates may be cyclically changed.

<Flow Rate of Fuel Fluid>

When the flow rate of the oxidant fluid is cyclically changed, the flow rate of the fuel fluid may be set constant, or cyclically changed. In contrast, when the flow rate of the oxidant fluid is set constant, the flow rate of the fuel fluid is cyclically changed.

<Oxygen Ratio>

Next, an oxygen ratio will be described below. The term "oxygen ratio" means a value provided by dividing the amount of supply of oxygen supplied to the burner 2 as the oxidant fluid by the theoretically required oxygen amount that is required for combustion of the fuel fluid supplied to the burner 2. Thus, the state of the oxygen ratio of 1.0 corresponds to a state that enables complete combustion using oxygen in just proportion, theoretically.

The theoretically required oxygen amount upon the combustion of LNG, which depends on the composition of LNG, is about 2.3 times more than that of LNG in terms of molar ratio.

In the present embodiment, at least one of the flow rates of the fuel fluid and the oxidant fluid is cyclically changed, and the concentration of oxygen in the oxidant fluid is also cyclically changed, so that the oxygen ratio is also cyclically changed.

For example, when the flow rate of the oxidant fluid is set constant with the flow rate of the oxidant fluid defined as 1, and the flow rate of the fuel fluid is cyclically changed, the concentration of oxygen in the oxidant is cyclically changed in a range of 21 to 100%, and the flow rate of the fuel fluid (LNG) is cyclically changed in a range of 0.05 to 0.65. As a result, the oxygen ratio is cyclically changed in a range of 0.14 to 8.7. The relationship among a flow rate $Q_f$ [$Nm^3/h$] of the fuel fluid (LNG), the flow rate $Q_{o2}$ [$Nm^3/h$] of the oxidant, the oxygen concentration $X_{o2}$ [vol %] of the oxidant, and the oxygen ratio m [–] is represented by the following equation (1):

$$m=(Q_{o2}\times X_{o2}/100)/(Q_f\times 2.3) \quad (1)$$

When the flow rate of the oxidant fluid is cyclically changed, the flow rate of the fuel fluid can be set constant. At this time, when, for example, the flow rate of the oxidant fluid is changed in a range of 1 to 2, the concentration of oxygen in the oxidant is changed in a range of 21 to 61%, and the flow rate of the fuel fluid (LNG) is 0.3 upon supply, then the oxygen ratio is cyclically changed in a range of 0.3 to 1.75. The relationship among the flow rate of the fuel fluid (LNG), the flow rate of the oxidant, the concentration of oxygen in the oxidant, and the oxygen ratio can also be represented by the same equation as the equation (1).

When the frequency of the cyclical change in oxygen ratio is large, the $NO_x$ reduction effect cannot be exhibited sufficiently. Thus, the frequency is preferably 20 Hz or less, and more preferably 5 Hz or less. In contrast, when the frequency of the cyclical change in oxygen ratio is excessively small, the amount of CO generated is increased. Thus, the frequency is preferably 0.02 Hz or more, and more preferably 0.03 Hz or more.

When a difference between the upper and lower limits of the oxygen ratio is small, the $NO_x$ reduction effect cannot be exhibited sufficiently. Thus, the difference between the upper and lower limits of the oxygen ratio is preferably 0.2 or more.

When an average oxygen ratio per time (average value per cycle) is small, incomplete combustion of the fuel fluid occurs. Thus, the average oxygen ratio is preferably 1.0 or more, and more preferably 1.05 or more.

As mentioned above, in the present embodiment, at least one of the flow rate of the fuel fluid (LNG) and the flow rate of the oxidant fluid, and the concentration of oxygen in the oxidant fluid are cyclically changed thereby cyclically changing the oxygen ratio.

Such cyclical changes are controlled by changing the flow rate of the fuel fluid, the flow rate of the oxygen, and the flow rate of the air. For example, when the flow rate of the fuel fluid is changed in a range of 0.5 to 1.5, the flow rate of the oxygen is changed in a range of 1.2 to 1.7, and the flow rate of the air is changed in a range of 0 to 9.2 at the time of supply, the oxygen ratio is cyclically changed in a range of 0.5 to 2.7, and the concentration of oxygen is cyclically changed in a range of 30 to 100%.

<Combustion of Burners>

Next, the combustion of the burners 2 will be described below. Each burner 2 performs temporal thick and thin combustion to cyclically change its oscillation state according to changes in flow rates of the fuel fluid and oxidant fluid supplied, and in concentration of oxygen in the oxidant fluid. The term "oscillation state" as used in the present invention specifically means the fluctuations in combustion state caused by changing the flow rate of at least one of the fuel and the oxidant.

In the present embodiment, as shown in FIG. 1, a plurality of burners 2 is provided inside the furnace 1. A phase difference between the cyclical change (oscillation cycle) in an oscillation state of each burner 2 and the oscillation cycle of another burner 2 opposed thereto is controlled to be $\pi$.

The term "burners 2 opposed to each other" as used herein means the burners are disposed in opposite positions of the opposed sidewalls 1*a* and 1*b*, which does not necessarily mean those located in opposed positions in a strict sense. That is, the opposed burners mean the burners 2 are located in the closest positions that cause the burners to be substantially opposite to each other. For example, the burner 2 opposed to a burner $\mathbf{2}a_1$ corresponds to a burner $\mathbf{2}b_1$, and the burner 2 opposed to a burner $\mathbf{2}a_2$ corresponds to a burner $\mathbf{2}b_2$.

Figure 3:
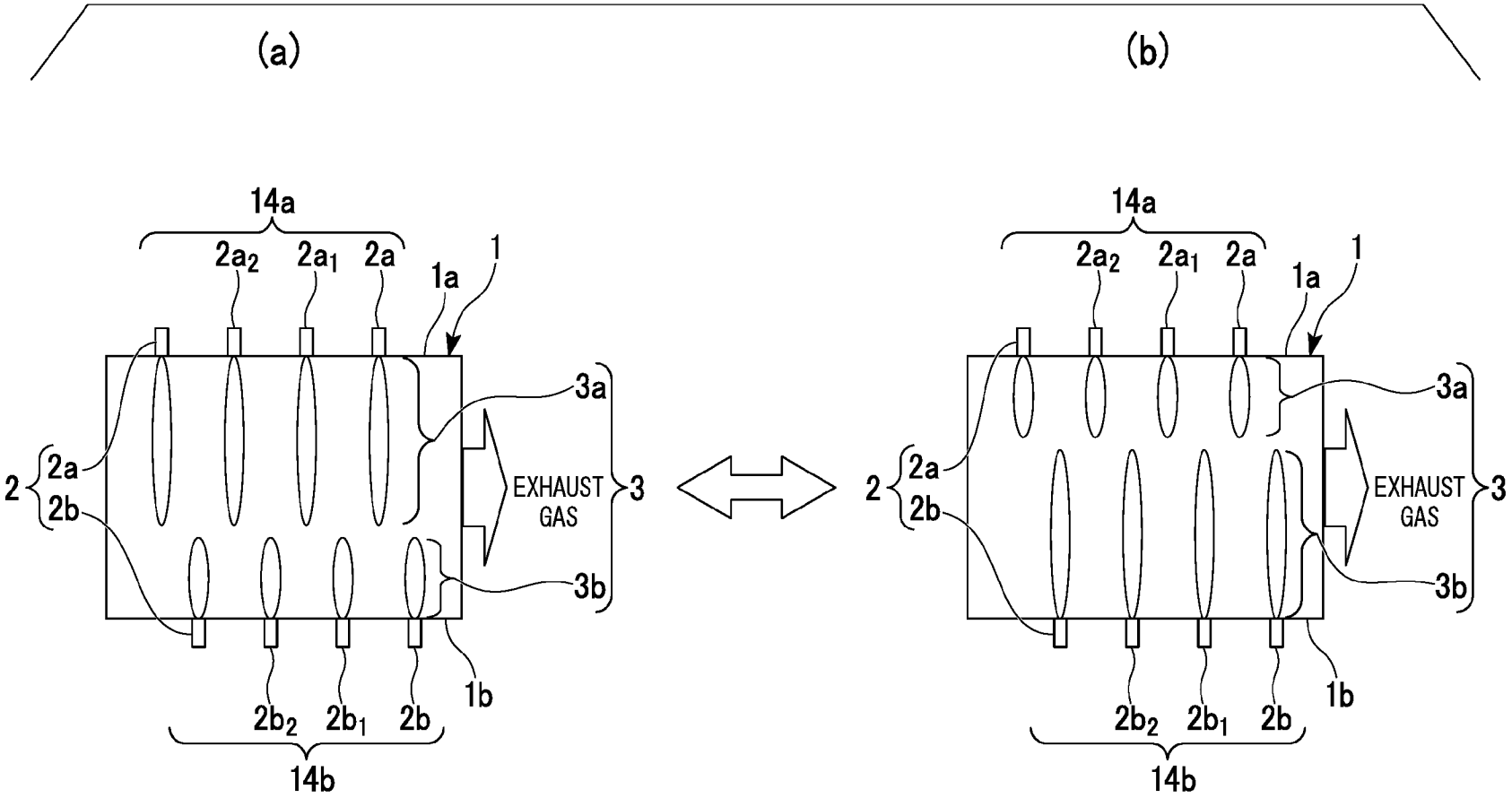
FIG. 3(*a*) and 3(*b*) are plan views showing a furnace according to the first embodiment of the present invention.

In the present embodiment, all burners 2*a* disposed on the sidewall 1*a* form the burner array 14*a*, in which all the respective burners 2*a* are synchronized with each other in terms of cyclical changes in flow rate of the fuel fluid, flow rate of the air, and flow rate of oxygen. All burners 2*b* disposed on the sidewall 1*b* form the burner array 14*b*, in which all the respective burners 2*b* are also synchronized with each other. As shown in FIG. 3(*a*), when the burner 2*a* disposed on the sidewall 1*a* combusts most strongly, the burner 2*b* disposed on the sidewall 1*b* combusts most weakly. In contrast, as shown in FIG. 3(*b*), when the burner 2*a* disposed on the sidewall 1*a* combusts most weakly, the burner 2*b* disposed on the sidewall 1*b* combusts most strongly.

All the burners 2*a* are synchronized with each other in terms of cyclical changes in flow rate of the fuel fluid, flow rate of the air, and flow rate of oxygen, so that they are also synchronized in terms of cyclical changes in oxygen ratio and concentration of oxygen. The term "synchronization" as used herein means the same waveform, frequency, and phase, and does not necessarily mean the same fluctuation range. For example, the burners $\mathbf{2}a_1$ and $\mathbf{2}a_2$ may differ from each other in fluctuation range.

The same shall apply for the burner 2*b*. All the burners 2*b* are synchronized with each other in terms of cyclical changes in oxygen ratio and concentration of oxygen, and may differ from each other in fluctuation range.

Synchronizing all the burners 2*a* and 2*b* disposed on the sidewalls 1*a* and 1*b* in terms of oxygen ratio preferably simultaneously brings the burners into the condition with a low oxygen ratio thereby widening an area lacking oxygen, resulting in improved effect of $NO_x$ reduction. Synchronizing the burners 2*a* and 2*b* disposed on the sidewalls 1*a* and 1*b* in terms of concentration of oxygen preferably simultaneously brings the burners into the condition with a low concentration of oxygen, which does not form a local high-temperature area, resulting in an improved effect of $NO_x$ reduction.

As to the relationship between the burners 2*a* and 2*b*, a phase difference therebetween is set to "π", and preferably the burners 2*a* and 2*b* have the same frequency and waveform in terms of at least one of cyclical changes in oxygen ratio and concentration of oxygen.

The opposed burners 2 preferably have the same fluctuation range. For example, preferably, the burner $\mathbf{2}a_1$ and the burner $\mathbf{2}b_1$ have the same waveform, frequency, and fluctuation range in terms of cyclical changes in oxygen ratio and concentration of oxygen, and have a phase difference of π.

As mentioned above, the burner combustion method according to the present embodiment can reliably reduce the amount of generated $NO_x$ to a large extent.

That is, in a conventional burner combustion method, only at least one of the flow rate of a fuel fluid and the flow rate of an oxidant fluid supplied to the burners is changed thereby cyclically changing only the oxygen ratio. In contrast, in the present embodiment, at least one of the flow rate of the fuel fluid and the flow rate of the oxidant fluid is cyclically changed, and at the same time the concentration of oxygen in the oxidant fluid is cyclically changed. Thus, it is made possible to exhibit a great effect of $NO_x$ reduction as compared to the prior art case.

When a plurality of burners disposed in the furnace have the same cyclical change in an oscillation state (oscillation cycle), a great effect of $NO_x$ reduction can be obtained, but the flow rates of the fuel fluid and the oxidant fluid into the burners are largely fluctuated, which results in an increase in fluctuations of the pressure in the furnace. In contrast, in the present embodiment, as to a cyclical change in an oscillation state of the burners 2, a phase difference is provided between the oscillation cycle of at least one burner 2 and that of another burner 2. This constitution provides a great effect of $NO_x$ reduction, while decreasing the fluctuations in flow rates of the fuel fluid and oxidant fluid supplied into the furnace 1, which can equalize the pressure applied to the furnace 1 by the burners 2.

In particular, the phase difference between the opposed burners 2 is set to π, which can obtain a great effect of $NO_x$ reduction, while keeping the pressure inside the furnace 1 constant.

The burner combustion method in the present embodiment can be applied not only to the case where a new heating furnace is designed, but also to the burners in the existing heating furnace or combustion furnace.

[Second Embodiment]

A burner combustion method according to a second embodiment to which the present invention is applied will be described below. The present embodiment is a modified example of the first embodiment, and thus a description of the same parts will be omitted below.

The present embodiment differs from the first embodiment in that the adjacent burners 2 have a phase difference in oscillation cycle, but is the same as the first embodiment except for this point.

Figure 4:
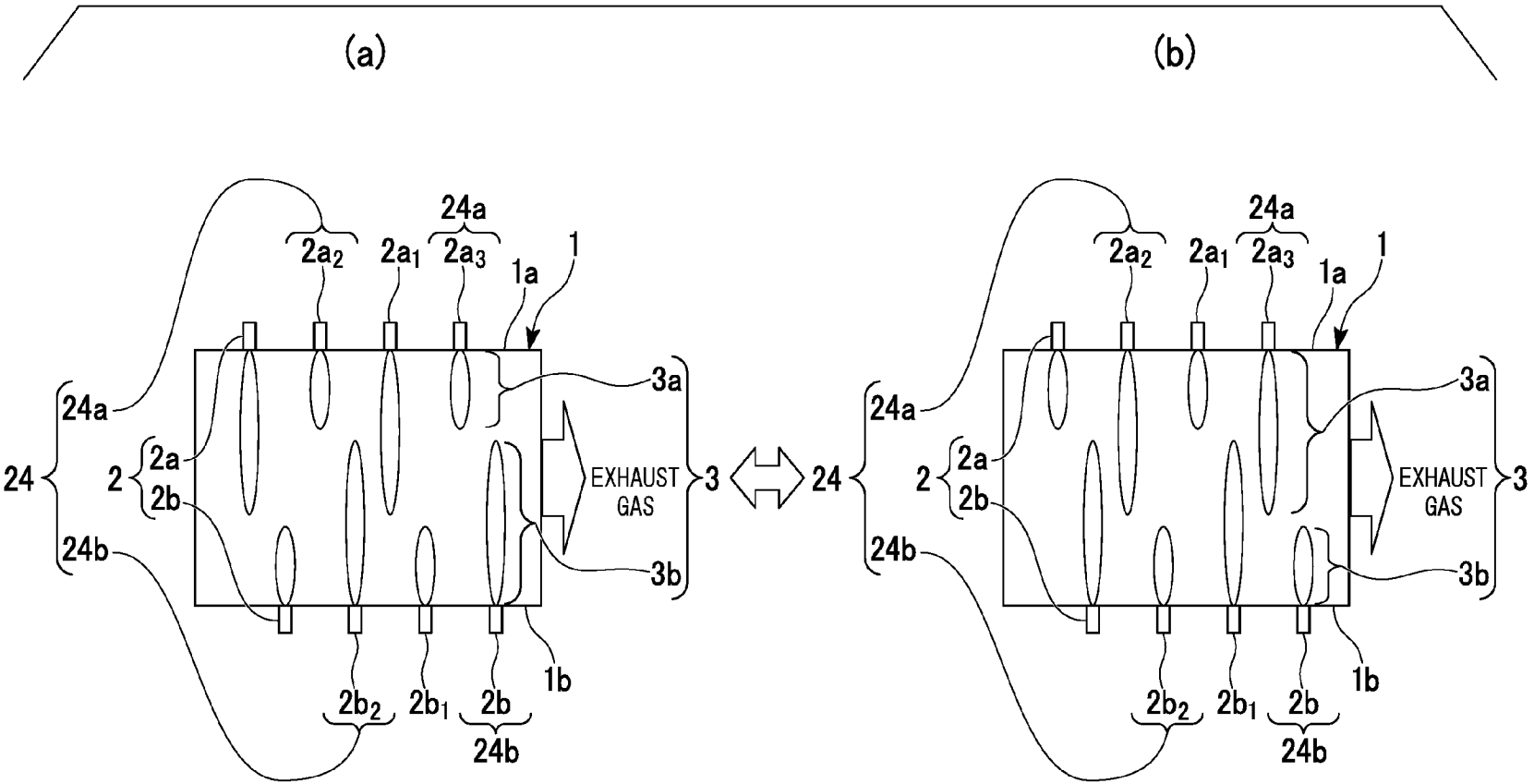
FIGS. 4(*a*) and 4(*b*) are plan views showing a furnace according to a second embodiment of the present invention.

As shown in FIGS. 4(*a*) and 4(*b*), also in the present embodiment, the sidewalls 1*a* and 1*b* are provided with a plurality of burners 2*a* and burners 2*b*, respectively. Each burner 2 forms a corresponding burner array 24 comprised of only one burner. That is, the burners 2*a* disposed on the sidewall 1*a* respectively form burner arrays 24*a*, and the burners 2*b* disposed on the sidewall 1*b* respectively form burner arrays 24*b*.

In the present embodiment, the adjacent burners 2 are controlled such that a phase difference in oscillation cycle therebetween is set to π. For example, as shown in FIG. 4(*a*), when the burner $\mathbf{2}a_1$ combusts most strongly, the burners $\mathbf{2}a_2$ and $\mathbf{2}a_3$ adjacent thereto combust most weakly. In contrast, as shown in FIG. 4(*b*), when the burner $\mathbf{2}a_1$ combusts most weakly, the burners $\mathbf{2}a_2$ and $\mathbf{2}a_3$ adjacent thereto combust most strongly.

At this time, a phase difference between the oscillation cycle of each burner 2 and the oscillation cycle of the opposed burner 2 is controlled to be set to π. For example, a phase difference in oscillation cycle between the burner $\mathbf{2}a_1$ and the burner $\mathbf{2}b_1$ opposed thereto is set to π, and a phase difference in oscillation cycle between the burner $\mathbf{2}a_2$ and the burner $\mathbf{2}b_2$ opposed thereto is set to π.

Also in the present embodiment, like the first embodiment, the concentration of oxygen in the oxidant fluid is cyclically changed, so that the $NO_x$ reduction effect can be exhibited to a large extent as compared to the prior art case.

The oscillation cycle of the burner 2 is controlled to have a phase difference of π from the oscillation cycle of the adjacent burner 2. As a result, the burner 2 which is made to combust with the high oxygen ratio and the low oxygen concentration and the burner 2 which is made to combust with the low oxygen ratio and the high oxygen concentration are alternately disposed along the longitudinal direction. Thus, the mixing is promoted to equalize the temperature distribution within the furnace, which can further reduce the amount of generated $NO_x$. Furthermore, the concentration of CO in an exhaust gas can be further decreased.

In the present embodiment, a burner array 24 is comprised of one burner 2, but may be comprised of a plurality of burners 2.

Figure 5:
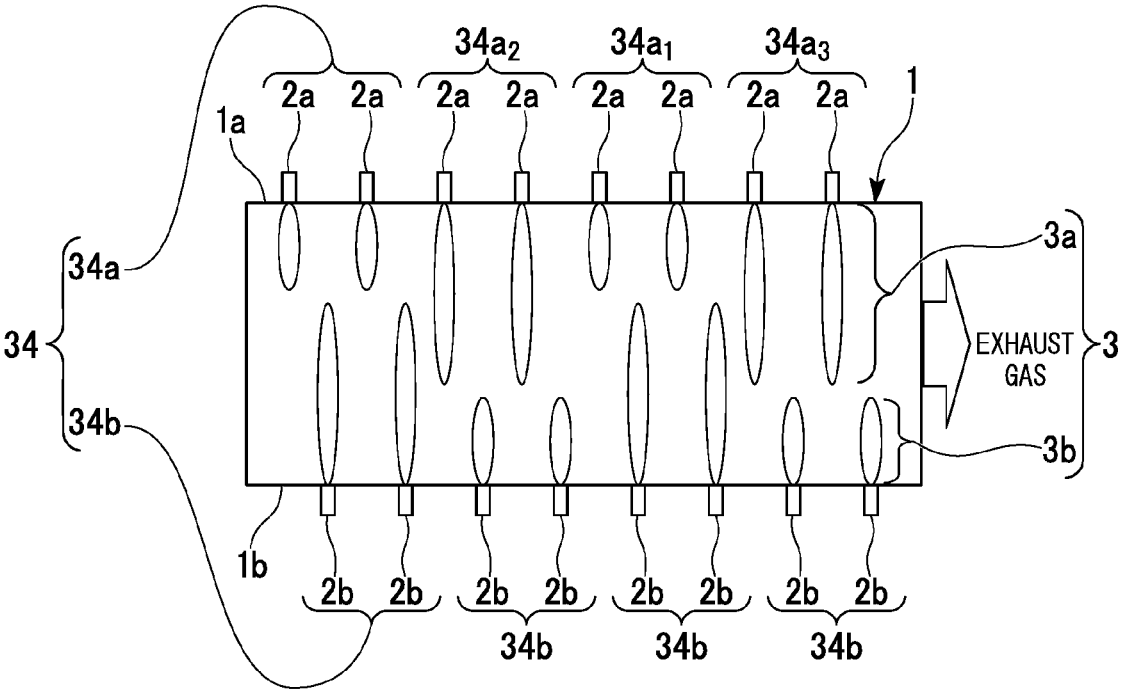
FIG. 5 is a plan view showing the furnace according to the second embodiment of the present invention.

That is, as shown in FIG. 5, a plurality of pairs of burner arrays 34*a*, each comprised of a plurality of burners 2*a*, may be provided on the sidewall 1*a* of the furnace 1, and a plurality of pairs of burner arrays 34*b*, each comprised of a plurality of burners 2*b*, may be provided on the sidewall 1*b* thereof. In that case, the burners 2 forming each burner array 34 and the burners 2 forming the burner array 34 adjacent to the above burner array 34 may be controlled to have a phase difference in oscillation cycle therebetween of π. For example, a phase difference between the oscillation cycle of the burners 2*a* forming the burner array $\mathbf{34}a_1$ and the oscillation cycle of the burners 2*a* forming the burner array $\mathbf{34}a_2$ and the burner array $\mathbf{34}a_3$ may be set to π.

[Third Embodiment]

A burner combustion method according to a third embodiment to which the present invention is applied will be described below. The present embodiment is a modified example of the first embodiment, and thus a description of the same parts will be omitted below.

Also, the present embodiment differs from the first embodiment in that a difference in oscillation cycle between the adjacent burners 2 is provided, but is the same as the first embodiment except for the above point.

Figure 6:
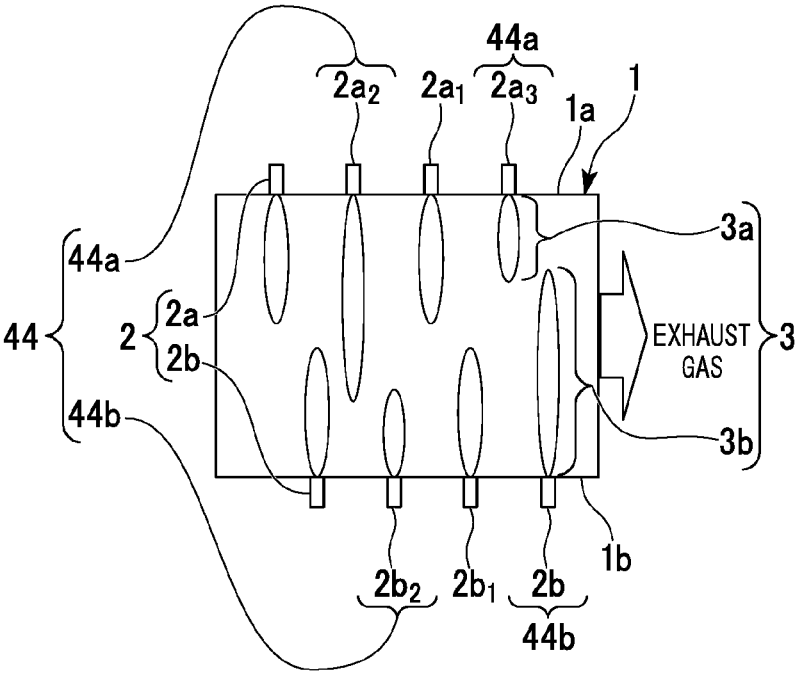
FIG. 6 is a plan view showing a furnace according to a third embodiment of the present invention.

That is, as shown in FIG. 6, in the present embodiment, "n" pieces of burners 2*a* and "n" pieces of burners 2*b* are provided on the sidewalls 1*a* and 1*b* of the furnace 1, respectively. Each burner array 44 is formed of only one burner 2. That is, each burner 2*a* provided on the sidewall 1*a* forms the burner array 44*a*, and each burner 2*b* provided on the sidewall 1*b* forms the burner array 44*b*.

In the present embodiment, a phase difference in oscillation cycle between the burners 2 adjacent to each other is controlled to be set to $2\pi/n$. For example, when four burners 2*a* are provided on the sidewall 1*a*, a phase difference between the oscillation cycle of the burner $\mathbf{2}a_1$ and the oscillation cycle of each of the adjacent burners $\mathbf{2}a_2$ and $\mathbf{2}a_3$ is controlled to be $\pi/2$. A phase difference between the oscillation cycle of the burner $\mathbf{2}a_2$ and the oscillation cycle of the burner $\mathbf{2}a_3$ is controlled to be $\pi$.

At this time, a phase difference between the oscillation cycle of each burner 2 and the oscillation cycle of the corresponding burner 2 opposed thereto is controlled to be $\pi$. For example, a phase difference in oscillation cycle between the burner $\mathbf{2}a_1$ and the opposed burner $\mathbf{2}b_1$ is set to $\pi$, and a phase difference in oscillation cycle between the burner $\mathbf{2}a_2$ and the opposed burner $\mathbf{2}b_2$ is set to $\pi$.

Also in the present embodiment, like the first embodiment, the concentration of oxygen in the oxidant fluid is cyclically changed, so that the $NO_x$ reduction effect can be exhibited to a large extent as compared to the prior art case.

Furthermore, when the number of the burners 2 disposed on the sidewall of the furnace is n, the phase difference between the oscillation cycle of the burner 2 and the oscillation cycle of the adjacent burner 2 is controlled to be $2\pi/n$. Thus, the fluctuations in flow rates of the fuel fluid and oxidant fluid supplied to the furnace 1 can be suppressed, so that the pressure inside the furnace 1 can be further equalized.

While a description has been made of the case where each burner array 44 is comprised of one burner 2 in the above embodiment, like the first embodiment, the burner array may be comprised of a plurality of burners 2.

Figure 7:
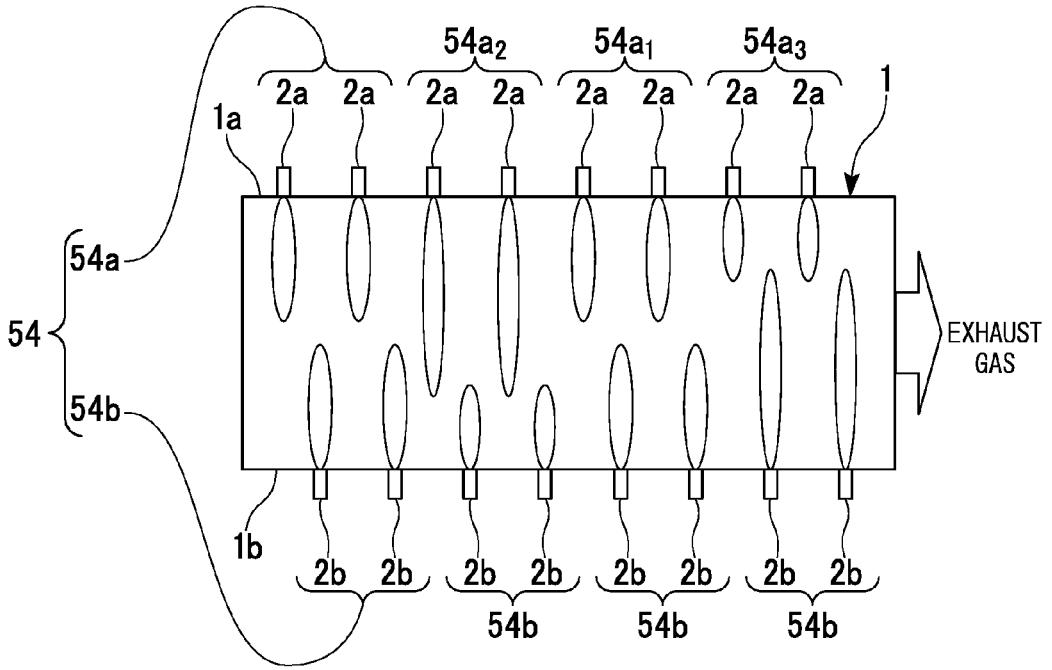
FIG. 7 is a plan view showing the furnace according to the third embodiment of the present invention.

That is, as shown in FIG. 7, n pairs of burner arrays 54*a* comprised of a plurality of burners 2*a* may be provided on the sidewall 1*a* of the furnace 1, and n pairs of burner arrays 54*b* comprised of a plurality of burners 2*b* may also be provided on the sidewall 1*b* of the furnace 1. In that case, a phase difference in oscillation cycle between the burners 2 forming the burner array 54 and the burners 2 forming another burner array 54 adjacent to the above burner array 54 may be controlled to be $2\pi/n$. For example, when four pairs of burner arrays 54*a*, each pair consisting of two burners 2*a*, are provided on the sidewall 1*a* of the furnace 1, a phase difference in oscillation cycle between the burners 2*a* forming the burner array $\mathbf{54}a_1$, and the burners 2*a* forming the burner arrays $\mathbf{54}a_2$ and $\mathbf{54}a_3$ should be set to $\pi/2$.

While the present invention has been described above based on embodiments, the present invention is not limited to the embodiments. It is apparent that various modifications and changes can be made to those embodiments without departing from the scope of the present invention.

A description is made, by way of examples, on the $NO_x$ reduction effect in a case where LNG is used as a fuel fluid and an oxidant fluid is formed of oxygen having the oxygen concentration of 99.6% and air, and then the oxygen ratio and the concentration of oxygen in the oxidant fluid are cyclically changed thereby causing forced oscillating combustion. The present invention is not limited to the following examples, and various modifications and changes can be made in the examples without departing from the scope of the present invention.

EXAMPLE 1

In Example 1, as shown in FIG. 3, a test was performed using a combustion device including eight burners 2 disposed in the furnace 1. Specifically, all burners 2 were adjusted to have the same waveform, fluctuation range, and frequency of the oxygen ratio and the oxygen concentration in the oxidant. The concentration of oxygen in the oxidant was cyclically changed in a range of 33 to 100%, and the oxygen ratio was cyclically changed in a range of 0.5 to 1.6. The frequency of each burner was set to 0.033 Hz. At this time, an average oxygen concentration in the oxidant per cycle (concentration per time) was set to 40%, and an average oxygen ratio was set to 1.05. A phase difference in cyclical change in each of the oxygen concentration and the oxygen ratio was set to $\pi$.

A phase difference between the oscillation cycle of the burner 2 provided on the sidewall 1*a* and the oscillation cycle of the burner 2 provided on the sidewall 1*b* is set to $\pi$.

The exhaust gas was continuously sucked from a gas duct using a suction pump, and then the concentration of $NO_x$ in the combustion exhaust gas was measured using a chemiluminescent continuous $NO_x$ concentration-measuring device.

For analysis of the test results, the concentration of $NO_x$ in the combustion exhaust gas in conventional oxygen-enriched combustion (stationary combustion) was measured using the same measuring device, and then the measured value was defined as a reference value $NO_x$ (ref).

In Example 1, the concentration of $NO_x$ was 90 ppm, and the $NO_x$ (ref) value was 850 ppm. As a result, the concentration of $NO_x$ was reduced by about 90% as compared to the $NO_x$(ref).

For comparison, like conventional forced oscillating combustion, a test was performed under the same conditions as in Example 1, except that the concentration of oxygen was fixed to 40%, and only the oxygen ratio was cyclically changed in a range of 0.5 to 1.6.

In Comparison Example 1, the concentration of $NO_x$ was 410 ppm, and the $NO_x$ (ref) value was 850 ppm. As a result, the concentration of $NO_x$ was reduced by about 50% as compared to the $NO_x$(ref).

EXAMPLE 2

Next, in Example 2, in order to examine the influences on the $NO_x$ concentration reduction effect by the oscillation frequency of the burners 2, the same conditions as those of Example 1 except for the frequency were set, and the frequency of each of the oxygen ratio and the oxygen concentration in the oxidant was changed in a range of 0.017 to 100 Hz. At this time, the frequencies of the oxygen ratio and the oxygen concentration in the oxidant were set to the same level.

The exhaust gas was continuously sucked from a gas duct using a suction pump, and then the concentration of CO in the combustion exhaust gas was measured using an infrared absorption continuous CO concentration-measuring device.

Figure 8:
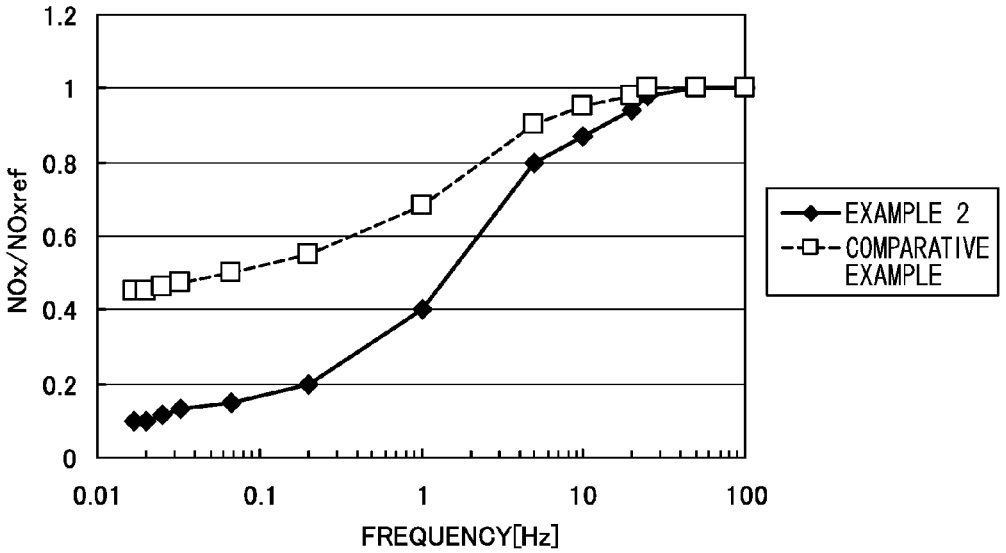
FIG. 8 is a graph showing a relationship between a frequency and an $NO_x$ concentration in one example of the present invention.
Figure 9:
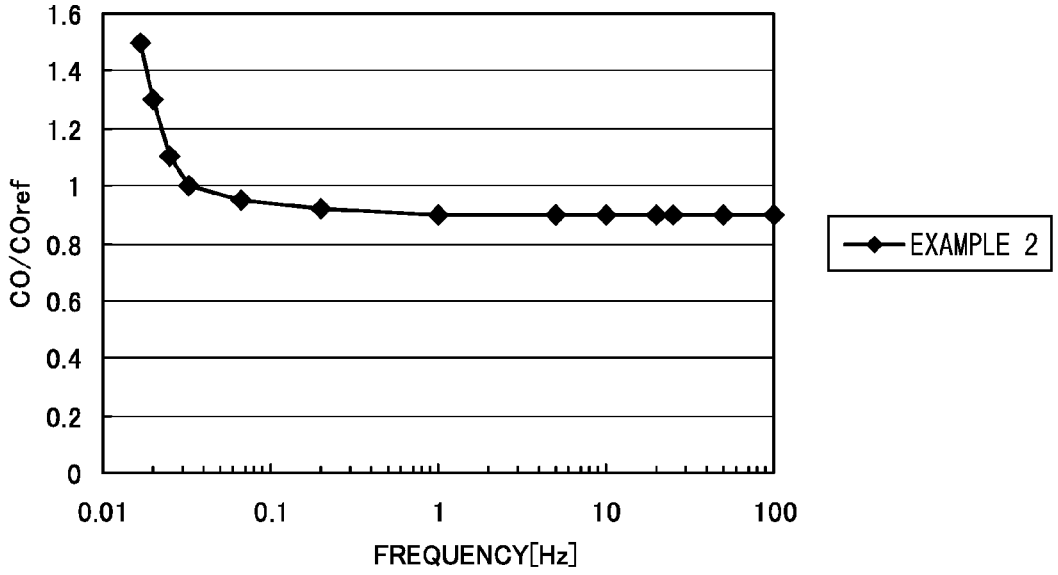
FIG. 9 is a graph showing a relationship between a frequency and a CO concentration in one example of the present invention.

The results of the $NO_x$ concentration are shown in Table 1 and FIG. 8, and the results of the CO concentration are shown in Table 2 and FIG. 9.

Upon analysis of the test results of CO concentrations, when a related art oxygen-enriched combustion (stationary combustion) was performed, the concentration of CO in the combustion exhaust gas was measured using the same measuring device, and then the measured value was defined as a reference value CO (ref). In FIGS. 8 and 9, a horizontal axis indicates the frequency of each of the oxygen concentration and the oxygen ratio, and a longitudinal axis indicates a $NO_x$ concentration ($NO_x/NO_x$(ref)) normalized using the reference $NO_x$(ref), or a CO concentration (CO/CO(ref))

normalized using the reference CO(ref). For comparison, the results of the $NO_x$ concentrations obtained by cyclically changing only the oxygen ratio in a range of 0.5 to 1.6 with the oxygen concentration fixed to 40%, like conventional forced oscillating combustion, are also shown in Table 1 and FIG. 8.

TABLE 1

| Frequency | Example 2 | Comparative Example |
|---|---|---|
| 0.017 | 0.1 | 0.45 |
| 0.02 | 0.1 | 0.45 |
| 0.025 | 0.115 | 0.465 |
| 0.033 | 0.13 | 0.475 |
| 0.067 | 0.15 | 0.5 |
| 0.2 | 0.2 | 0.55 |
| 1 | 0.4 | 0.68 |
| 5 | 0.8 | 0.9 |
| 10 | 0.87 | 0.95 |
| 20 | 0.94 | 0.98 |
| 25 | 0.98 | 1 |
| 50 | 1 | 1 |
| 100 | 1 | 1 |

As is apparent from Table 1 and FIG. 8, the $NO_x$ concentration tends to drastically decrease by setting the frequency to 20 Hz or less, and when the frequency of a cyclical change in each of oxygen ratio and concentration of oxygen in the oxidant is set to 20 Hz or less, a greater $NO_x$ reduction effect can be obtained.

TABLE 2

| Frequency | Example 2 |
|---|---|
| 0.017 | 1.5 |
| 0.02 | 1.3 |
| 0.025 | 1.1 |
| 0.033 | 1 |
| 0.067 | 0.95 |
| 0.2 | 0.92 |
| 1 | 0.9 |
| 5 | 0.9 |
| 10 | 0.9 |
| 20 | 0.9 |
| 25 | 0.9 |
| 50 | 0.9 |
| 100 | 0.9 |

As is apparent from Table 2 and FIG. 9, the concentration of CO is not influenced so much by the frequency in a range of 0.017 to 100 Hz, and particularly, less influenced by the frequency of 0.02 Hz or more.

EXAMPLE 3

Next, in Example 3, the influence on the $NO_x$ concentration reduction effect by the fluctuation range of the oxygen ratio was examined with the flow rate of fuel set constant. Specifically, the concentration of $NO_x$ was measured by cyclically changing the oxygen concentration in a range of 30 to 100%, and by changing the fluctuation range in oxygen ratio.

Under each of the conditions of the lower limits of the oxygen ratio of 0.1, 0.2, 0.3, 0.4, and 0.5, the concentration of $NO_x$ in the exhaust gas was measured by changing the upper limit of the oxygen ratio in a range of 1.1 to 7.

The average oxygen ratio per time was set to 1.05, and the concentration of oxygen in the oxidant fluid was set to 40%. For example, for an oxygen ratio m of 0.5 to 5, a combustion time interval at m<1.05 was adjusted to be set longer than that at m>1.05. Conversely, for an oxygen ratio m of 0.2 to 1.2, a combustion time interval at m<1.05 was adjusted to be set shorter than that at m>1.05. Since each of the flow rate of fuel, the average oxygen ratio, and the average oxygen concentration is set constant, the amount of oxygen used for each certain time period is the same.

Figure 10:
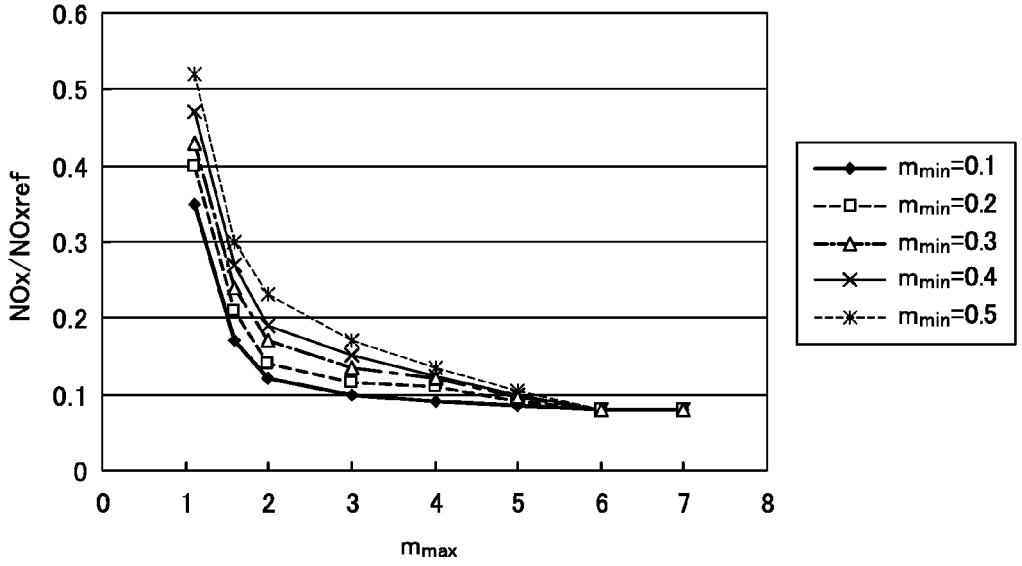
FIG. 10 is a graph showing a relationship between the oxygen ratio and the $NO_x$ concentration in one example of the present invention.
Figure 11:
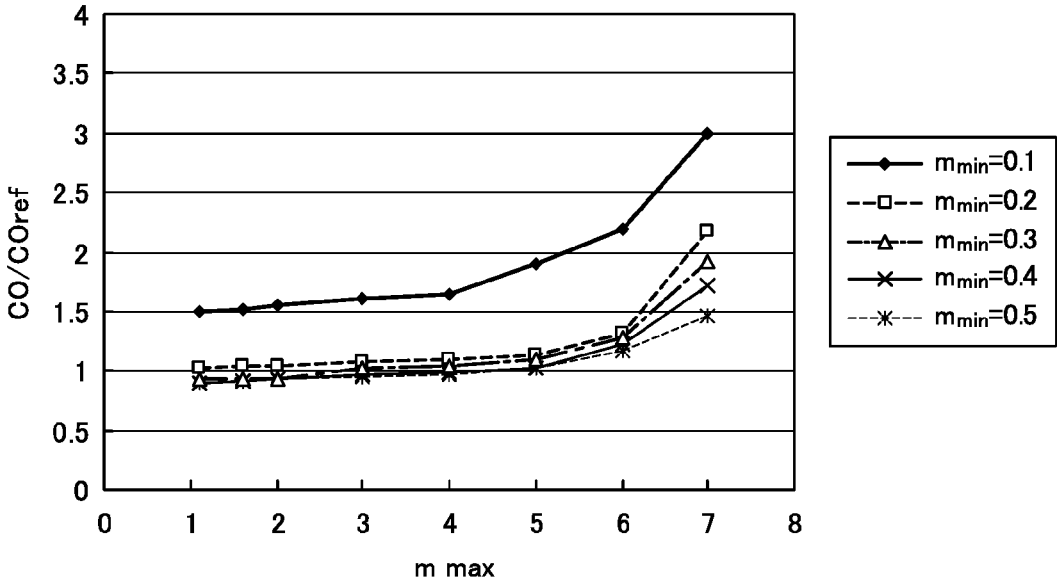
FIG. 11 is a graph showing a relationship between the oxygen ratio and the CO concentration in one example of the present invention.

The measurement results of the $NO_x$ concentration are shown in Table 3 and FIG. 10, and the measurement results of the CO concentration are shown in Table 4 and FIG. 11. In FIGS. 10 and 11, the horizontal axis indicates the upper limit $m_{max}$ of the oxygen ratio, and the longitudinal axis indicates the normalized $NO_x$ concentration or the normalized CO concentration. The values shown in Table 3 and Table 4 are the normalized $NO_x$ concentration or the normalized CO concentration.

TABLE 3

| $m_{max}$ | $m_{min}$ = 0.1 | $m_{min}$ = 0.2 | $m_{min}$ = 0.3 | $m_{min}$ = 0.4 | $m_{min}$ = 0.5 |
|---|---|---|---|---|---|
| 1.1 | 0.35 | 0.4 | 0.43 | 0.47 | 0.52 |
| 1.6 | 0.17 | 0.21 | 0.24 | 0.27 | 0.3 |
| 2 | 0.12 | 0.14 | 0.17 | 0.19 | 0.23 |
| 3 | 0.1 | 0.115 | 0.135 | 0.15 | 0.17 |
| 4 | 0.09 | 0.11 | 0.12 | 0.125 | 0.135 |
| 5 | 0.085 | 0.09 | 0.095 | 0.1 | 0.105 |
| 6 | 0.08 | 0.08 | 0.08 | 0.08 | 0.08 |
| 7 | 0.08 | 0.08 | 0.08 | 0.08 | 0.08 |

TABLE 4

| $m_{max}$ | $m_{min}$ = 0.1 | $m_{min}$ = 0.2 | $m_{min}$ = 0.3 | $m_{min}$ = 0.4 | $m_{min}$ = 0.5 |
|---|---|---|---|---|---|
| 1.1 | 1.5 | 1.02 | 0.93 | 0.9 | 0.9 |
| 1.6 | 1.52 | 1.04 | 0.93 | 0.92 | 0.92 |
| 2 | 1.55 | 1.05 | 0.94 | 0.93 | 0.93 |
| 3 | 1.6 | 1.07 | 1.02 | 0.96 | 0.95 |
| 4 | 1.65 | 1.1 | 1.05 | 0.98 | 0.97 |
| 5 | 1.9 | 1.13 | 1.09 | 1.03 | 1.02 |
| 6 | 2.2 | 1.32 | 1.27 | 1.22 | 1.17 |
| 7 | 3 | 2.17 | 1.92 | 1.72 | 1.47 |

As is apparent from Table 3, Table 4, FIG. 10, and FIG. 11, as the lower limit $m_{min}$ of the oxygen ratio increases, the $NO_x$ concentration tends to increase and the CO concentration tends to decrease.

As is apparent from Table 3 and FIG. 10, in the graph of $m_{min}$=0.5, as the $m_{max}$ increases (amplitude of oxygen ratio increases), the $NO_x$ concentration decreases, while the NO concentration becomes constant for $m_{max}$>5. In the graph of $m_{min}$=0.3, the $NO_x$ concentration decreases as compared to the graph of $m_{min}$=0.5, while there is little difference between the case of $m_{min}$=0.2 and the case of $m_{min}$=0.3.

Thus, in order to decrease both the $NO_x$ concentration and the CO concentration, the lower limit $m_{min}$ of the oxygen ratio is preferably 0.3.

As is apparent from Table 4 and FIG. 11, as the upper limit $m_{max}$ of the oxygen ratio increases, the CO concentration increases. In particular, it is apparent that the CO concentration drastically increases for $m_{max}$>6.

Thus, in the present invention, it is apparent that the oxygen ratio is preferably changed in a range of 0.3 to 6 in order to decrease the CO concentration together with the $NO_x$ concentration in the exhaust gas.

EXAMPLE 4

In Example 4, the influence on the amount of NO emission by the fluctuation range of the oxygen concentration was examined with the flow rate of fuel set constant, by changing the oxygen ratio in a range of 0.5 to 1.6, and also by changing the fluctuation range of the oxygen concentration. In a test, the lower limit of the oxygen concentration was set to 33%, and the upper limit $C_{max}$ of the oxygen concentration was changed in a range of 50 to 100%. The average oxygen ratio was set to 1.05, and the oxygen concentration in the oxidant was set to 40%.

The frequencies of the oxygen ratio and oxygen concentration was set to 0.067 Hz, and the phase difference in cyclical change in each of the oxygen ratio and the oxygen concentration was set to π. The results are shown in Table 5.

TABLE 5

| Maximum oxygen concentration $C_{max}$ | $NO_X$ concentration $NO_X/NO_X$ (ref) |
|---|---|
| 50 | 0.55 |
| 60 | 0.4 |
| 70 | 0.35 |
| 80 | 0.33 |
| 90 | 0.31 |
| 100 | 0.3 |

As is apparent from Table 5, as the fluctuation range of the oxygen concentration increases, the $NO_x$ concentration reduction effect further increases.

EXAMPLE 5

Then, in Example 5, as shown in FIG. 4, the $NO_x$ concentration reduction effect was examined when the oscillation cycle of each burner 2 is shifted in phase by π from the oscillation cycle of the adjacent burner 2 in operation. Specifically, all the burners 2 were made to cause combustion while being set to have the same waveform, oscillation range, and frequency of cyclical changes in oxygen ratio and oxygen concentration with a phase difference of π between the burners alternately disposed. Furthermore, the oscillation cycle of each burner 2 was shifted in phase by π from the oscillation cycle of the opposed burner 2.

The concentration of oxygen in the oxidant is cyclically changed in a range of 33 to 100%, and the oxygen ratio is cyclically changed in a range of 0.5 to 1.6. At this time, the average oxygen concentration per time was set to 40%, and the oxygen ratio was set to 1.05. A test was performed at the frequencies of cyclical changes in oxygen concentration and oxygen ratio of 0.033 Hz. The phase difference in cyclical change in each of oxygen concentration and oxygen ratio was set to π.

The measurement results of $NO_x$ concentration are shown in Table 6. The measurement results of CO concentration are shown in Table 7.

TABLE 6

| | $NO_X/NO_X$ ref |
|---|---|
| Example 1 | 0.3 |
| Example 5 | 0.21 |

TABLE 7

| | CO/CO ref |
|---|---|
| Example 1 | 0.90 |
| Example 5 | 0.73 |

As is apparent from Table 6, in Example 5, the $NO_x$ concentration further decreases as compared to Example 1. As is apparent from Table 7, in Example 5, the CO concentration further decreases as compared to Example 1.

EXAMPLE 6

Next, when in Example 6, four burners on each side were shifted in phase by π/2 in operation, the $NO_x$ concentration reduction effect was examined. Specifically, like Example 1, all the burners 2 were set to have the same waveform, fluctuation range, and frequency of each of the oxygen ratio and the oxygen concentration. As shown in FIG. 6, the combustion was performed such that a phase difference between the oscillation cycle of four burners 2 disposed on each of the sidewall 1*a* and the sidewall 1*b* and the oscillation cycle of the adjacent burners 2 was set to "π/2". The oscillation cycle of each burner 2 was shifted in phase by π from the oscillation cycle of the opposed burner 2.

In the measurement of the $NO_x$ concentration, $NO_x/NO_x$ (ref) was found to be 0.3, which was the same level as in Example 1. In Example 6, in the measurement of a fluctuation range of the pressure in the furnace, the fluctuation range was found to be in a range of −1 to +1 mmAq, which suppresses the fluctuations in pressure to the same level as that in the case of stationary combustion.

INDUSTRIAL APPLICABILITY

The present invention can provide a combustion method and device of a burner that is of practical value and which exhibits the effect of $NO_x$ reduction.

REFERENCE SIGNS LIST

1 Furnace
1*a*, 1*b* Sidewall
2, 2*a*, 2*b*, 2*a*$_1$, 2*a*$_2$, 2*a*$_3$, 2*b*$_1$, 2*b*$_2$, 2*b*$_3$ Burner
3, 3*a*, 3*b* Combustion flame
14*a*, 14*b*, 24, 24*a*, 24*b*, 34, 34*a*, 34*b*, 44, 44*a*, 44*b*, 54, 54*a*, 54*b* Burner array
5 Fuel supply pipe
6 Oxidant fluid supply pipe
7 Oxygen supply pipe
8 Air supply pipe
9 Temperature sensor
10 Gas duct
11 Continuous exhaust gas concentration-measuring device ($NO_x$, CO, $CO_2$, $O_2$)
12 Data storage unit
13 Control system
14 Control unit
15 Oscillating combustion

The invention claimed is:

1. A burner combustion method in which at least two burners are disposed opposite each other in a furnace so as to cause combustion, the method comprising:

cyclically changing at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, wherein with respect to the cyclical change in an oscillation state of the burners, a phase difference is provided between a cyclical change in oxygen ratio and oxygen concentration of at least one burner and cyclical changes in oxygen ratio and oxygen concentration of other burners, and a phase difference in the cyclical change between the oxygen ratio and oxygen concentration of the burners disposed opposite each other is π.

2. The method for combusting a burner according to claim 1, wherein a phase difference is provided between a cyclical change in flow rate of the fuel fluid supplied to each burner and a cyclical change in oxygen concentration and oxygen ratio.

3. The method for combusting a burner according to claim 1, wherein the frequency of the cyclical change in oxygen ratio is 20 Hz or less.

4. The method for combusting a burner according to claim 1, wherein the frequency of the cyclical change in oxygen ratio is 0.02 Hz or more.

5. The method for combusting a burner according to claim 1, wherein a difference between an upper limit and a lower limit of the oxygen ratio cyclically changed is 0.2 or more, and an average value of the oxygen ratio per cycle is 1.0 or more.

6. The method for combusting a burner according to claim 1, wherein all burners are synchronized in terms of at least one of the cyclical change in oxygen ratio and the cyclical change in oxygen concentration thereby causing combustion.

7. The method for combusting a burner according to claim 1, wherein a phase difference is provided between the cyclical change in oxygen ratio and oxygen concentration of at least one burner and the cyclical change in oxygen ratio and oxygen concentration of another burner thereby keeping the pressure inside the furnace constant.

8. A combustion device of a burner in which at least two burners are disposed opposite each other in a furnace so as to cause combustion, characterized in that:

the combustion device is adapted to cyclically change at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, and with respect to the cyclical change in an oscillation state of the burners, a phase difference is provided between a cyclical change in oxygen ratio and oxygen concentration of at least one burner and cyclical changes in oxygen ratio and oxygen concentration of other burners, and a phase difference in the cyclical change between the oxygen ratio and oxygen concentration of the burners disposed opposite each other is π.

9. The combustion device of a burner according to claim 8, wherein the combustion device includes a fuel supply pipe for supplying the fuel, an oxygen supply pipe for supplying oxygen, and an air supply pipe for supplying air, and the supplied oxygen and air form the oxidant, and the combustion device includes forced oscillation means for forcedly oscillating the flows of the supplied fuel, oxygen, and air via the respective pipes.

10. The combustion device of a burner according to claim 9, wherein a detector for grasping an atmosphere state of the furnace is disposed in the furnace, and the combustion device includes a control system for changing the flow rate of the fuel fluid or the oxidant fluid, or the cycle of the forced oscillation, based on data detected by the detector.

11. A combustion device of a burner in which at least two burners are disposed opposite each other in a furnace so as to cause combustion, characterized in that:

the combustion device is adapted to cyclically change at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, and with respect to the cyclical change in an oscillation state of the burners, a phase difference is provided between a cyclical change in oxygen ratio and oxygen concentration of at least one burner and cyclical changes in oxygen ratio and oxygen concentration of other burners, and when performing combustion using a burner array including one or more burners, two or more pairs of the burner arrays are disposed on a sidewall of the furnace, and a phase difference between a cyclical change in oxygen ratio and oxygen concentration of the burner forming each burner array, and a cyclical change in oxygen ratio and oxygen concentration of the burner forming another burner array disposed adjacent to the burner array is π.

12. A combustion device of a burner in which at least two burners are disposed opposite each other in a furnace so as to cause combustion, characterized in that:

the combustion device is adapted to cyclically change at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, and with respect to the cyclical change in an oscillation state of the burners, a phase difference is provided between a cyclical change in oxygen ratio and oxygen concentration of at least one burner and cyclical changes in oxygen ratio and oxygen concentration of other burners, and when performing combustion using a burner array including one or more burners, sidewalls of the furnace are opposed to each other, and n pairs of burner arrays are disposed on one sidewall, and a phase difference between a cyclical change in oxygen ratio and oxygen concentration of the burner forming each burner array, and a cyclical change in oxygen ratio and oxygen concentration of the burner forming another burner array disposed adjacent to the burner array is $2\pi/n$.

13. A burner combustion method in which at least two burners are disposed opposite each other in a furnace so as to cause combustion, the method comprising:

cyclically changing at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, wherein with respect to the cyclical change in an oscillation state of the burners, a phase difference is provided between a cyclical change in oxygen ratio and oxygen concentration of at least one burner and cyclical changes in oxygen ratio and oxygen concentration of other burners, and when performing combustion using a burner array including one or more burners, two or more pairs of the burner arrays are disposed on a sidewall of the furnace, and a phase difference between a cyclical change in oxygen ratio and oxygen concentration of the burner forming each burner array, and a cyclical change in oxygen ratio and oxygen concentration of the burner forming another burner array disposed adjacent to the burner array is $\pi$.

14. A burner combustion method in which at least two burners are disposed opposite each other in a furnace so as to cause combustion, the method comprising:

cyclically changing at least one of a flow rate of a fuel fluid and a flow rate of an oxidant fluid supplied to the respective burners, while cyclically changing a concentration of oxygen in the oxidant fluid thereby cyclically changing an oxygen ratio obtained by dividing a supply oxygen amount by a theoretically required oxygen amount, whereby, the burners are made to cause combustion in a cyclical oscillation state, wherein with respect to the cyclical change in an oscillation state of the burners, a phase difference is provided between a cyclical change in oxygen ratio and oxygen concentration of at least one burner and cyclical changes in oxygen ratio and oxygen concentration of other burners, and when performing combustion using a burner array including one or more burners, sidewalls of the furnace are opposed to each other, and n pairs of burner arrays are disposed on one sidewall, and a phase difference between a cyclical change in oxygen ratio and oxygen concentration of the burner forming each burner array, and a cyclical change in oxygen ratio and oxygen concentration of the burner forming another burner array disposed adjacent to the burner array is $2\pi/n$.

* * * * *